US005104035A

United States Patent [19]

Rosenbaum, II

[11] Patent Number: 5,104,035

[45] Date of Patent: Apr. 14, 1992

[54] CARTON WITH HINGE LOCK CONSTRUCTION

[75] Inventor: John W. Rosenbaum, II, Indianapolis, Ind.

[73] Assignee: Inland Container Corporation, Indianapolis, Ind.

[21] Appl. No.: 591,818

[22] Filed: Oct. 2, 1990

[51] Int. Cl.[5] ..... B65D 5/10

[52] U.S. Cl. ..... 229/157; 229/156

[58] Field of Search ..... 229/155, 156, 157, 158, 229/185

[56] References Cited

U.S. PATENT DOCUMENTS

| | | | |
|---|---|---|---|
| 292,863 | 2/1884 | Schmidt . | |
| 490,167 | 1/1893 | Schmidt . | |
| 980,931 | 1/1911 | DuVal . | |
| 1,997,667 | 4/1935 | Woerner, Jr. . | |
| 2,339,224 | 1/1944 | Shina . | |
| 2,361,603 | 10/1944 | Cohen et al. . | |
| 2,990,993 | 7/1961 | Buttery . | |
| 3,074,613 | 1/1963 | Cupo . | |
| 3,178,096 | 4/1965 | Reeves et al. . | |
| 3,539,090 | 10/1970 | Blasdell | 229/157 |
| 4,279,377 | 7/1981 | Peeples et al. | 229/185 |
| 4,279,379 | 7/1981 | Lohrbach et al. . | |
| 4,291,827 | 9/1981 | Mulroy . | |
| 4,367,840 | 1/1983 | McFadden | 229/157 |
| 4,614,298 | 9/1986 | Cherry . | |
| 4,650,112 | 3/1987 | Booth . | |
| 4,702,408 | 10/1987 | Powlenko . | |
| 4,821,949 | 4/1989 | Booth | 229/156 |

FOREIGN PATENT DOCUMENTS 218420 11/1961 Austria .

*Primary Examiner*—Stephen Marcus
*Assistant Examiner*—Christopher J. McDonald
*Attorney, Agent, or Firm*—Fitch, Even, Tabin & Flannery

[57] ABSTRACT

A carton having a tubular body with a pair of opposed sidewalls and a pair of opposed endwalls, with end panels and side panels for a closure extending therefrom. At least one end panel is hinged to an endwall and has a free edge defining a pair of spaced notches with a retention flap therebetween, thereby forming a pair of locking tabs, one at each free corner of the end panel. At least one hinged tab is struck out from each side panel. The hinged tab includes a tab hinge line and a double-ended severing line extending to spaced apart portions of the tab hinge line so as to form a tab which is swingable out of the plane of the side panel, thereby exposing a locking edge of the side panel formed by the severing line. The locking tabs of the end panel deflect the hinge tabs into the interior of the carton to form recesses in the side panels into which the locking tabs are inserted so that the locking edge of the tab engages the locking edge of the side panel.

4 Claims, 3 Drawing Sheets

CARTON WITH HINGE LOCK CONSTRUCTION

BACKGROUND OF THE INVENTION

1. Field of the Invention

The present invention pertains to cartons, and in particular, to cartons constructed from paper products such as paperboard and cardboard.

2. Description of the Related Art

It is desirable, in many applications, to ship cartons in a "knocked-down" condition, preferably in the form of flat blanks stacked in palletized loads. When shipped to a user, the palletized loads are easily stored until needed. Thereafter, the carton blanks can be removed and erected as required.

In general, it is desirable that the carton blank be erected without requiring the use of adhesives or fasteners such as staples and the like, and users prefer carton blank designs where only a few simple folding operations are needed to fully erect a carton. From a load-carrying standpoint, the carton bottom construction is most critical and considerable attention has been paid over the years this aspect of foldable carton constructions.

It is known, for example, to provide a carton bottom construction with interlocking bottom flaps, where a corner or edge of one bottom flap is inserted in a minimally sized slit formed in an adjoining carton flap. Examples of such constructions are found in U.S. Pat. Nos. 292,683; 490,167; 980,931; 1,997,667; 2,339,224; 2,990,993; and 4,367,840. At times, it is difficult to insert a carton flap into a slit in an adjoining carton panel, and attempts have been made to provide enlarged slits for receiving the corners or edges of an adjoining bottom closure flap. Examples of such constructions are given in U.S. Pat. Nos. 2,361,603; 3,074,613; 3,178,096; 4,279,377; 4,279,379; 4,291,827; 4,614,298; and 4,702,408.

Enlarging the slots on carton bottom panels made it easier to insert adjacent flaps therein. However, concerns were raised that the retention ability of the resulting carton bottom constructions would be compromised. Attempts have been made to improve the locking retention of carton bottom constructions having enlarged slots for receiving the edges or corners of adjacent carton bottom panels. For example, U.S. Pat. No. 4,650,112 provides enlarged L-shaped slots on the major-sized carton bottom panels. The minor flaps of the carton bottom have a central, rectangular cutout forming locking legs at the corners of the minor flap. The legs are inserted into the L-shaped slot and engage one side of the slot, to provide flap retention. A similar flap retention is provided in U.S. Pat. No. 4,821,949 and Austria Patent No. 218,420.

Despite such developments in carton bottom constructions, improvements are constantly being sought. For example, U.S. Pat. Nos. 4,650,112 and 4,821,949 provided score lines on the carton flap carrying the locking legs to facilitate insertion of the legs in a locking slot or a slit formed in an adjacent carton bottom panel. The legs provided for locking are disposed at corners of a carton bottom flap, and are separated by an intervening generally rectangular cutout portion. The legs located at the corners of the carton flap are prone to bending, resulting in a reduced area of contact between the locking legs and the carton flaps receiving those legs. It is desired to make such legs stronger and to more efficiently use the material in that portion of the carton blank allocated to the locking legs.

It is desirable to form the locking portions of a carton bottom panel in an economical manner, so as to maximize the usefulness of the carton material employed in locking the carton bottom. For example, U.S. Pat. No. 4,702,408 provides locking flaps with pairs of spaced apart generally trapezoidal notches, defining locking corners. The locking portions are received in rectangular openings formed in adjacent carton flaps, oriented along diagonals of the carton bottom. The locking portions of the mating flaps are generally arranged at angles to one another, with a reduced area of contact, reducing the efficient use of the material used in the interlocking member. The same problems are experienced in the collapsible box of U.S. Pat. No. 2,361,603 which utilizes generally truncated triangular notches in one locking panel, receivable in diagonal slits expanded to form an arcuate edge. It is desirable to improve the design of carton locking members so as to more efficiently use the material of the interlocking components.

These and other objects according to the present invention, which will become apparent from studying the appended description and drawings, are provided in a carton apparatus comprising:

a tubular body with a pair of opposed sidewalls and a pair of opposed endwalls;

at least one closure extending from the sidewalls and endwalls so as to form at least a partially enclosed interior therewith, said at least one closure comprising:

end panels joined to the endwalls with a hinge line so as to be foldable into a common plane;

at least one end panel having a free edge remote from the hinge line with a pair of free corners remote from the hinge line and extending from the free edge, the end panel further comprising a fold line between the free edge and the hinge line so as to divide the end panel into two parts to allow the part carrying the free edge to be swung out of the plane of the other end panel part;

the free edge defining a pair of spaced notches with a retention flap therebetween so as to define a pair of locking tabs, one at each free corner of the end panel, the locking tabs extending from the free corners to respective notches and including a locking edge formed by the notches extending at an angle to the hinge line;

side panels joined to the sidewalls with a hinge line so as to be foldable toward the common plane;

at least one hinged tab struck out from each side panel, comprising a tab hinge line extending at an angle to the hinge line which joins the side panel to its respective sidewall and the hinge tab further comprising a double-ended severing line extending to spaced apart portions of the tab hinge line so as to form a tab which is swingable out of the plane of the side panel, thereby exposing a locking edge of the side panel formed by the severing line; and the side panels and end panels foldable toward a common plane, with the locking tabs of the end panel deflecting the hinge tabs into the interior of the carton to form recesses in the side panels into which the locking tabs are inserted so that the locking edge of the tab engages the locking edge of the side panel.

BRIEF DESCRIPTION OF THE DRAWINGS

In the drawings, wherein like elements are referenced alike.

DETAILED DESCRIPTION OF THE PREFERRED EMBODIMENTS

Figure 1:
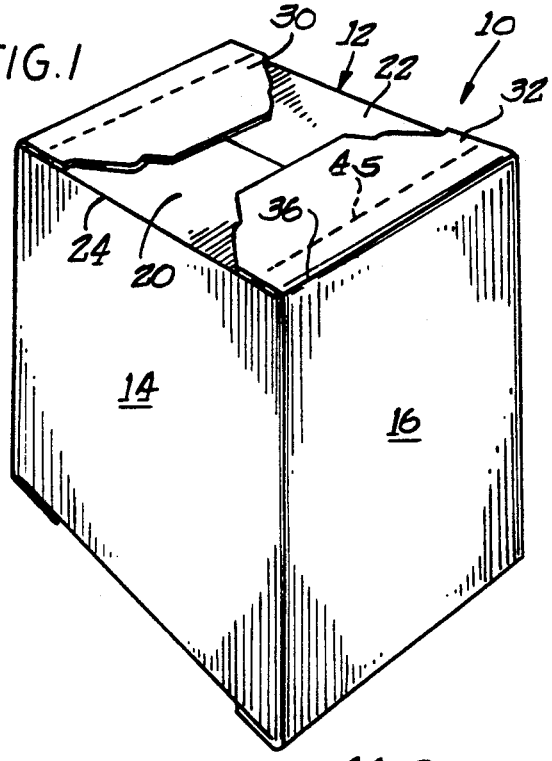
FIG. 1 is a perspective view of a carton, inverted to show a locking bottom illustrating aspects according to the present invention.
Figure 2:
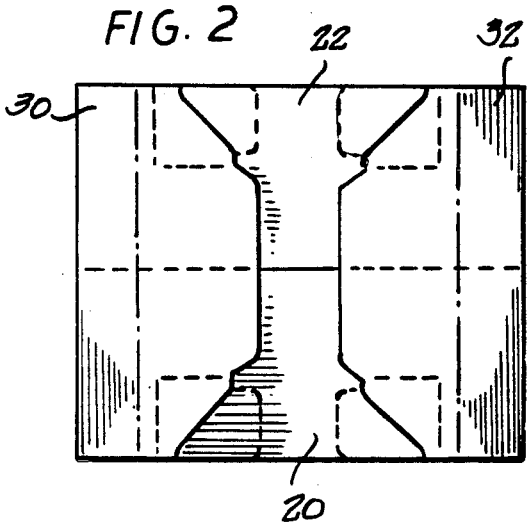
FIG. 2 is a plan view of the carton bottom thereof.
Figure 3:
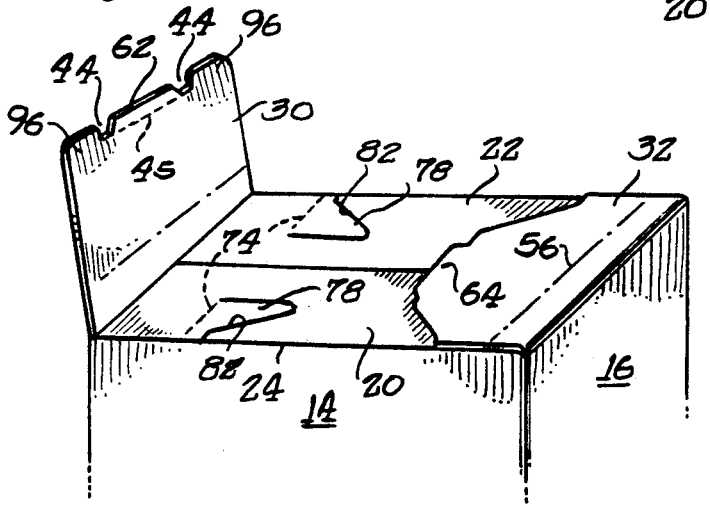
FIG. 3 is a fragmentary perspective view thereof, showing one locking flap thereof in a raised position.

Referring now to the drawings, and initially to FIGS. 1–4, a carton is generally indicated at 10, and is shown in an inverted position such that the carton bottom thereof, generally indicated at 12, is visible. Carton 10 includes sidewalls 14 and endwalls 16, arranged in pairs to enclose a generally rectangular carton interior. The carton bottom 12 of the preferred embodiment, preferably has four interlocking bottom closure panels. The larger side panels 20, 22 are secured to the sidewalls 14 by fold or hinge lines 24, 26, respectively, and the smaller end panels 30, 32 are secured to the endwalls 16 with fold lines 34, 36, respectively.

Figure 4:
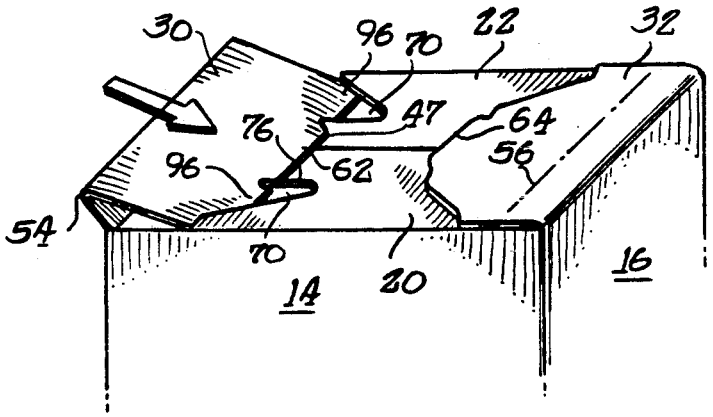
FIG. 4 is a fragmentary perspective view thereof, showing the raised flap of FIG. 3 being inserted in a pair of adjoining mating flaps.
Figure 5:
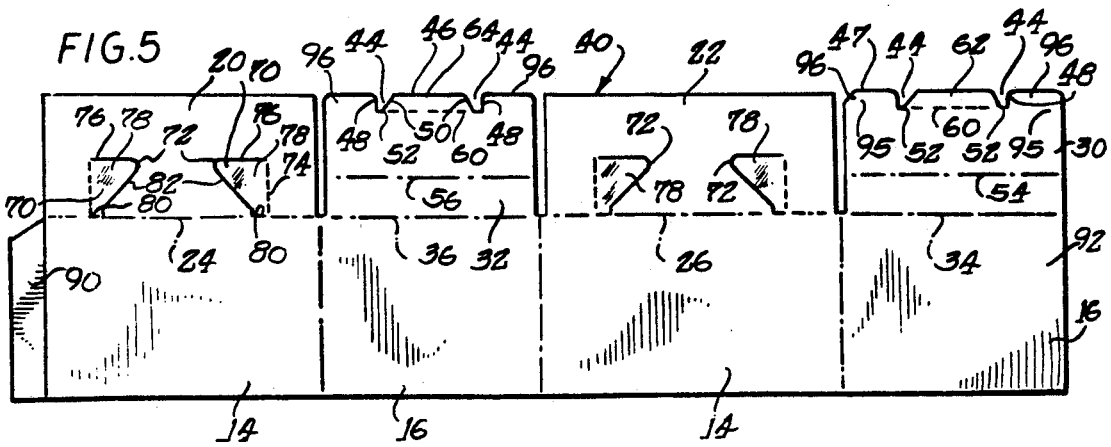
FIG. 5 is a plan view of a blank from which the carton of FIG. 1 is made.

FIG. 5 shows a carton blank generally indicated at 40, from which the carton of FIGS. 1–4 is formed. As can be seen in FIG. 5, the side panels 20, 22 are generally identical, and define locking recesses formed adjacent the fold lines 24, 26. The end panels 30, 32 are generally identical to one another and define locking tabs at the corners thereof to be received in the locking recesses of the side panels.

Referring to FIG. 5, the end panel 32 has a pair of spaced notches 44, formed at the free edge 46 thereof. The notches 44 have three edges, an outboard locking edge 48, extending generally perpendicular to the free edge 46, and an opposed angled or bevelled edge 50. The notches also have an intermediate edge 52, which extends generally parallel to the free edge 46, and has a length at least as great as the thickness of the sheet material from which the blank 40 is formed. It can be seen, from examining either panel 30 or panel 32, that the notches 44 of a panel are mirror images of one another. The panels 30, 32 also include fold lines 54, 56 extending generally parallel to the fold lines 34, 36, respectively. The fold lines 54, 56 are spaced between the fold line (either 34 or 36), joining the end panel to the endwall and the free edge 46, 47 of the end panel. The intermediate fold lines 54, 56, are however, spaced considerably closer to the fold line joining the end panel to the carton endwall. Hinge or score lines 60 extend between the notches of a panel, forming retention tabs 62, 64.

The side panels 20, 22 have a pair of spaced hinged tabs 78, which are struck out from the side panels, leaving generally right angle triangular locking tab recesses 70, which are arranged such that the rounded corners or pointed tips 72 thereof, oppose one another.

Edges 74 form one side of the recesses 70 and, according to one aspect of the present invention, are formed as score or hinge lines, rather than being cut through, as with the double ended severing line 75 (see FIG. 6), which extends from spaced apart portions of the hinge lines 74, to form the remaining edges of the recess. The edges 74 therefore comprise tab hinge lines, which provide a hinge mounting for the hinged tabs 78 formed by recesses 70.

The recesses 70 have three major sides or edges of significant length, including edges 74, 76, forming a right angle corner, and which extend generally parallel to the outer free edges of the panel. The third major side is formed by a diagonal edge 82, which guides insertion of the locking tabs, as will be seen herein. The preferred recesses have a fourth, minor edge 80, extending along the fold line (either 24 or 26), joining the panel to the carton sidewall.

Figure 6:
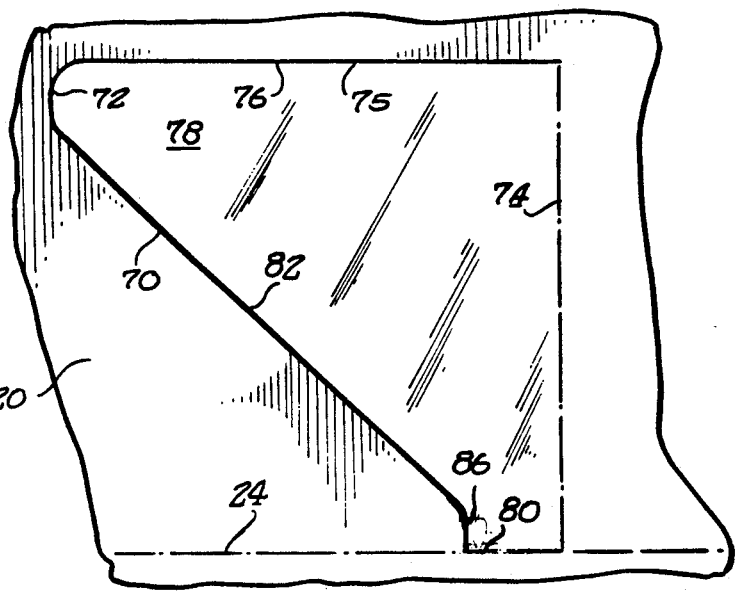
FIG. 6 is a fragmentary view of the carton blank shown on an enlarged scale.

With reference to FIG. 5, the right-hand recess 70 is illustrated on an enlarged scale, in FIG. 6. In the preferred embodiment, the corner 72 of recess 70, joining edges 76, 82, is rounded and the remaining corners are formed generally at right angles. Also, in the preferred embodiment, an optional minor edge 86 is inserted between edges 80, 82, and extends generally parallel to edge 74, normal to fold line 24.

Referring again to FIGS. 3 and 4, and additionally to FIG. 5, the carton blank is assembled by folding the sidewalls and endwalls to form a rectangular tube, and securing the manufacturer's joint flap 90 to the edge 92 of endwall 16, located at the opposing free edge of the carton blank 40. Thereafter, the side panels 20, 22 are swung about their respective fold lines 24, 26, being lowered to the position indicated in FIG. 3, and the end panels are bent at their intermediate fold lines (either 54 or 56), in preparation for insertion in the locking recesses. For example, as illustrated in FIG. 4, the end panel 30 is bent at its intermediate fold line 54, so that its free edge 47 may be retracted from the fold or score line 74 to permit its telescopic insertion in the locking recess 70. As indicated in FIG. 4, the free edge of retention tab 62 is drawn across the exposed surfaces of side panels 20, 22 providing a rapid and easy alignment of the minor locking panel to the major locking panels, while limiting the depth of insertion in the locking recesses 70.

Referring again to FIG. 5, the notches 44 of end panels 30, 32 extend from the free edges 47, 46. The notches 44 form locking tabs 96 at the outside free corners 95 of the end panels. As mentioned, the locking recesses 70 are preferably not fully cut, but rather a hinge line 74 at one edge thereof, remains to retain tabs 78 filling the recesses. As the locking tabs 96 of the end panel are mated with the side panels, they contact the tabs 78, displacing the tabs into the carton interior and exposing the recesses 70. Thereafter, the locking tabs 96 are inserted into recesses 70 in the manner illustrated in FIG. 4. As mentioned, the depth of insertion of the locking tabs 96 is limited by contact between retention tab 62 and the side panels 20, 22, and insertion is also limited by the hinged tabs which also shield any product that may be present in the carton. As the tabs 96 are inserted in recesses 70, the locking edge 48, located at the outside edge of the locking tab, is positioned adjacent and preferably slides along the recess edge 76 (see FIG. 4). Insertion of the locking tabs within recesses 70 is completed when the intermediate edge 52 of notches 44, contacts the rounded corner 72 of recess edges 76, 82.

It is important that the edges 48 of the locking tabs 96 be maintained in contact with the edges 76 of recesses 70, and that the area of contact therebetween be made as large as possible. Further, contact should be maintained when the carton bottom is placed under a load. The area of contact between the edges of the locking tab and the edges of the locking recesses can be significantly reduced, if the locking tabs are bent away from a generally parallel orientation with the locking edges of the side panels.

Several features of the present invention cooperate to prevent such bending, which is most likely to occur when the carton is filled with a loosely packed product, allowing the locking tabs to become upturned when placed under a load. One important feature of the present invention is the retention of carton blank material between the notches 44, this portion having been referred to as retention tabs 62 or 64. The presence of a retention tab reduces the likelihood that the locking tabs 96, originally formed coplanar with the remainder of the end panel 30 or 32, should be bent away therefrom. The diagonal edge 82 of locking recess 70, is so oriented to reduce the risk of buckling or bending of the locking tab and is angled away from a direction generally parallel to the free edge of the end panel.

As mentioned with reference to FIG. 6, a minor edge 86 is preferably inserted between the recess edges 80, 82, and the corner between edges 82, 86 is preferably rounded. This rounded corner, slightly spaced from the fold line joining the side panel to the carton sidewall, applies a pressure to the locking tab at a localized portion thereof, to prestress the locking tab, further rendering the locking tab resistant to creasing or bending in a way which reduces the contact area with edge 76 of the locking recess. As a further aid in maintaining the desired orientation of the locking tab, the hinged tab 78 remains in contact with the inside surface of the locking tab, that surface extending toward or facing toward the carton interior. The tabs 78 are of a substantial size, increasing the probability that even very loosely packed product will bear against the tabs 78 and hence, press the locking tabs 96 against the side panels of the carton bottom.

As will now be seen, the above advantages are attained in a carton apparatus 10, comprising a tubular body with a pair of opposed endwalls 16 and a pair of opposed sidewalls 14. The terms "endwalls" and "sidewalls" are arbitrary, and are used for ease of reference, the terms "end" and "side" having no particular significance. The carton of FIG. 1 has a closure 12, referred to above as the carton bottom closure. The term "bottom" is also arbitrary, and has no particular significance, apart from its reference value as used herein. For example, the carton 10 is described as being inverted in FIG. 1, to show the carton bottom construction 12. However, as will soon be seen herein, the same closure 12 could also be at the "top" of the carton in addition to or exclusive of a similar closure at the opposite end of the carton.

The closure 12 extends from the sidewalls 14 and endwalls 16, so as to form at least a partially enclosed interior therewith, and if similar enclosures are provided at each end of the carton a completely enclosed carton interior is achieved. As was seen in FIG. 5, end panels 32 extend from endwalls 16, and side panels 20 extend from sidewalls 14 being connected thereto by respective hinge members 36, 24, respectively. The end panel 32 has a free edge 46 remote from the hinge line 36. The end panel 32 has a pair of locking tabs 96 at the outside free corners 95 of panel 32. The outside free corners 95 are those corners remote from the hinge line 36, the corners of the end panel adjacent the hinge line 36, not being "free" by reason of joinder to the hinge line. Accordingly, the free corners 95 are described as extending from the free edge 46 of end panel 32.

Fold lines 54, 56 are provided in the end panels 30, 32 and are located between the free edges 46, 47 and the hinge lines 34, 36 joining the end panels to their respective endwalls. The fold lines 54, 56 divide the end panels into two parts, to allow the part carrying the free edge of the panel to be swung out of the plane of the remaining end panel part.

As has been seen, the free edges 46, 47 of the end panels each define a pair of spaced notches 44, so as to define retention panels 62, 64 therebetween in end panels 30, 32, and retention flap 64 is formed in end panel 32. Each end panel has a pair of locking tabs 96 extending from the free corners of the end panel to the notches formed in the end panel free edge. The outside edges 48 of notches 44 comprise locking edges and, according to a principle of the present invention, the locking edges 48 extend at an angle to the fold line 36. For example, in the embodiment illustrated in FIG. 5, the notches 44 have a generally trapezoidal configuration, but the locking edges 48 extend in a direction generally perpendicular to the fold line 36. If desired, the locking edges 48 could extend at an angle other than 90°, and the notches may even have a "keystone" shape, although such has not been found to be necessary.

In the carton blank shown in FIG. 5, the sidewalls 14 each have a pair of hinged tabs 78 struck out therefrom. The hinged tabs comprise a hinge line 74 extending at an angle, preferably a right angle, to the hinge lines 24, 26 of the side panels, and a double-ended severing line 75 extending to spaced apart portions of the tab hinge lines 74, so as to form a tab which is swingable out of the plane of the side panel 20, 22, so as to expose locking edges 76.

The side panels 20, 22 and end panels 32, 34 are foldable toward a common plane, i.e. the plane of closure 12. During assembly of the carton, the locking tabs 78 may be pushed out of the plane of their respective side panel or such displacement of the locking tabs may be accomplished during insertion of the locking tabs in the side panels, wherein the free edges 46, 47 of the locking tabs bear against and deflect the hinged tabs toward the carton interior, thereby exposing the recesses 70 in the side panels into which the locking tabs are inserted. Accordingly, the locking edges 48 of the locking tabs, engage the locking edges 76 formed in the hinged tab recesses.

As described above, the carton has a pair of notches formed in each end panel and a pair of hinged tabs formed in each side panel. The total number of these components may be cut in half if desired, as will now be explained with reference to FIG. 7, wherein each side panel has a single hinged tab and only one end panel has a pair of notches.

Figure 7:
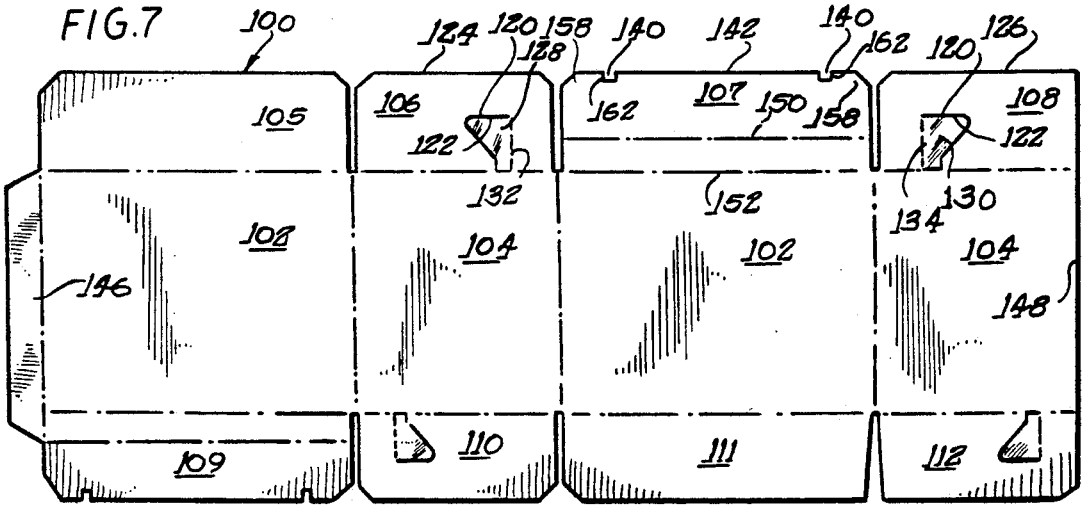
FIG. 7 is a plan view of an alternative embodiment illustrating aspects according to the present invention.

Referring now to FIG. 7, a carton blank, generally indicated at 100, illustrates another embodiment according to principles of the present invention. The blank 100 includes sidewalls 102 and endwalls 104. Top side panels 109, 111 and top end panels 110, 112 are folded in a common plane to form a top closure for the carton. Bottom side panels 105, 107 and bottom end panels 106, 108 are folded in a common plane to form a bottom closure for the carton.

The bottom closure panels 105–108 have generally rectangular configurations, as do the top closure panels 109–112. The number and types of panels for the bottom closure are the same as those for the top closure, although the order or sequence of their arrangement is different in the preferred embodiment of FIG. 7. The end panels 106, 108 of the bottom closure each have a recess 120, similar in configuration to the recess 70 shown in FIG. 6, for example. The recess 120 includes a mating edge 122, extending generally parallel to the free edge 124, 126 of the respective panel. In the preferred embodiment, the recess 120 is filled by a hinged flap 128, 130, secured to the end panel by a fold or hinge line 132, 134, respectively. In the preferred embodiment illustrated in FIG. 7, one side panel 105 is uninterrupted, whereas the second side panel 107 has a pair of generally square notches 140 formed in its free edge 142. The notches 140 include outboard edges 144.

Upon assembly of the carton blank 100, the sidewalls and endwalls are folded to form a tube having a generally rectangular cross-section. The manufacturer's joint tab 146 is secured to the edge 148 of end panel 104 using adhesive. Thereafter, the side panel 105 is bent at a right angle to the sidewall 102, and the end panels 106, 108 are bent to overlie the side panel 105. As can be seen in FIG. 7, a hinge or fold line 150 is located parallel to and adjacent the fold line 152, joining panel 107 to sidewall 102. The panel 107 is bent about fold line 150 to facilitate interlocking of side panel 107 with the locking recesses 120.

As with the preceding embodiment, the notches formed in the free edge of side panel 107 form locking tabs, herein locking tabs 158 at the outer corners of panel 107. After bending of the panel 107 about fold line 150, the locking tabs 158 are inserted in recesses 120, with the outboard edges 162 of notches 140 being positioned immediately adjacent, and preferably in contact with the edges 122 of recesses 120. Insertion of the locking tab within recess 120 continues until the medial edge 52 of notch 140 contacts the rounded corner located at one end of recess edges 122. The locking tabs 158 are placed in contact with the panels 128, 130 causing the panels to pivot or swing about their respective fold lines 132, 134. If desired, the side panel 105 can be dimensioned so as to partially overlap the locking tabs 158, further insuring the desired alignment of the outboard edges 162 with the recess edges 122. The top closure panels 109–112 are assembled in a similar manner.

As can be seen in FIG. 7, only one side panel is provided with notches to form locking tabs, and the minor panels each include only a single recess for locking cooperation with the notched side panel. If desired, both side panels could be notched so as to have locking tabs, and a pair of mirror image locking recesses could be formed in each minor panel to provide interlocking of both side panels with an end panel.

Figure 8:
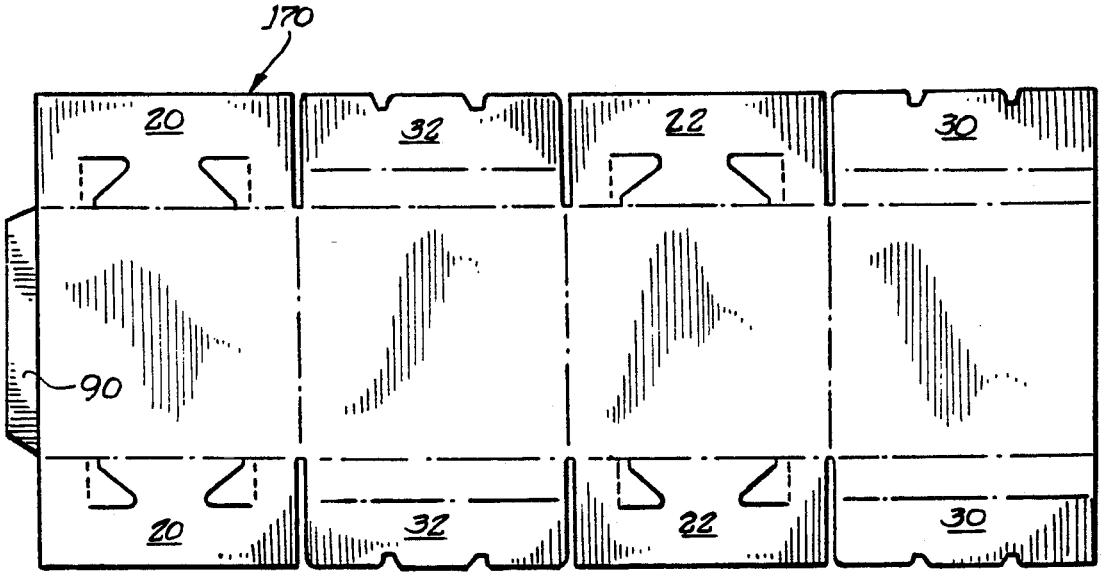
FIG. 8 is a plan view of a carton blank of another alternative embodiment illustrating aspects according to the present invention.

Referring now to FIG. 8, an integral carton blank is generally indicated at 170. As can be seen with comparison to FIG. 5, carton blank 170 is comprised of two carton blanks 40 placed back-to-back in abutting engagement. The carton blank 170 is symmetric about a longitudinal center line drawn through the blank and either portion of the carton blank, lined to one side of the longitudinal center line, can serve as either the carton top closure or the carton bottom closure, the closures being assembled and functioning as described above with reference to FIG. 5.

As can be seen from the above, a certain number of advantages are attained with a carton constructed according to principles of the present invention. For example, the hinged flaps (e.g. 78) provide a guide surface against which locking tabs (e.g. 96) slide as they are inserted in the manner illustrated in FIG. 4. Further, the hinged flaps 78 shield any product within the carton from inadvertent contact with the locking tabs 96 during assembly of the carton, and prevent the locking tabs from "diving" into the carton interior, thus acting as a guide surface which restricts intrusion of the locking tabs into the carton interior. Further, the bias or angled edge (e.g. 82) of the hinged flap recesses (e.g. 70), which contact the locking tab during insertion present a decreased resistance, spreading the friction forces throughout the length of the edge, thus reducing stress concentrations such as those stresses which would be encountered with a convex-shaped edge.

Other advantages are attained with the present invention, which provides a retention tab spanning the distance between notches in the panels carrying the locking tabs. Preferably, a score line or line of weakness (e.g. 45) is provided to encourage bending of retention tab (e.g. 62) out of the plane of the panels (e.g. 30). Thus, a folded portion of panels 30, 32 spans the side panels 20, 22 between recesses 70, the fold line or score line 45 presenting a line of reinforcement spanning the side panels 20, 22, and providing an increased retention strength resisting outward bulging and bottom package strength.

As will become apparent to those skilled in the art from studying the description and drawings, the above-described advantages are obtained with either the trapezoidal-shaped notch 44 of FIG. 5, or the rectangular-shaped notch 140 of FIG. 7.

Heretofore, locking tabs have been difficult to insert and thus have been limited to carton bottom constructions, where the improved performance is necessary. However, with the advantages and features of the present invention, improved locking tab insertion is made possible and is not suitable for carton top constructions, such as that illustrated in FIG. 8. Further, although efforts are made to preserve a preferred orientation of a carton during shipping and handling, it is possible that the carton might become inverted and thus, it is desirable in some applications to have the locking construction of the present invention at both top and bottom ends of the carton.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton apparatus comprising:

a tubular body with a pair of opposed sidewalls and a pair of opposed endwalls;

at least one closure extending from the sidewalls and endwalls so as to form at least a partially enclosed interior therewith, said at least one closure comprising:

end panels joined to the endwalls with a hinge line so as to be foldable into a common plane;

each end panel having a free edge remote from the hinge line with a pair of free corners remote from the hinge line and extending from the free edge, the end panel further comprising a fold line between the free edge and the hinge line so as to divide the end panel into two parts to allow the part carrying the free edge to be swung out of the plane of the other end panel part;

the free edge defining a pair of spaced notches with a retention flap therebetween so as to define a pair of locking tabs, one at each free corner of the end panel, the locking tabs extending from the free corners to respective notches and including a locking edge formed by the notches extending at an angle to the hinge line;

side panels joined to the sidewalls with a side hinge line so as to be foldable toward the common plane;

at least one hinged tab struck out from each side panel, having a generally right angle triangular configuration and comprising a tab hinge line extending at an angle to the side hinge line and first and second double ended severing lines, the first severing line having a generally V-shaped configuration with a first end remote from the side hinge line extending at a generally right angle to the tab hinge line and the second severing line located adjacent the side hinge line, between the remaining end of the first severing line and a portion of the tab hinge line, the second severing line including a locking edge adjacent the side hinge line and a rounded corner spaced from the tab hinge line, with the remaining end of the first severing line extending from the rounded corner, the tab thereby being swingable out of the plane of the side panel, so as to expose the locking edge of the side panel formed by the second severing line; and the side panels and end panels foldable toward a common plane, with the locking tabs of the end panels deflecting the hinge tabs into the interior of the carton to form recesses in the side panels into which the locking tabs are inserted so that the locking edges of the tabs engage the locking edges of the side panels.

2. The apparatus of claim 1 wherein the notches are generally trapezoidal shaped, having a pair of spaced converging edges extending from the end panel free edge.

3. The apparatus of claim 1 wherein the notches are generally rectangular shaped, having a pair of spaced edges extending from the end panel free edge in a direction generally perpendicular thereto.

4. The apparatus of claim 1 wherein the end panel includes a fold line extending between the notches for hinge connection of retention flap to the end panel.

* * * * *

UNITED STATES PATENT AND TRADEMARK OFFICE

CERTIFICATE OF CORRECTION

PATENT NO. : 5,104,035

DATED : April 14, 1992

INVENTOR(S) : John W. Rosenbaum

It is certified that error appears in the above-identified patent and that said Letters Patent is hereby corrected as shown below:

IN THE CLAIMS:

In Column 9, line 27, (Claim 1) after the word "configuration" insert the phrase --with first and second line portions--.

In Column 9, line 27, (Claim 1) after the word "with" insert the phrase --the first line portion of the V-shape forming a locking edge having--.

In Column 9, line 28, (Claim 1) after the word "line" insert --and--.

In Column 10, line 3, (Claim 1) delete the word "locking" and insert in its stead the word --side--.

In Column 10, line 10, (Claim 1) delete the word "second" and insert in its stead the word --first--.

In Column 10, line 16, (Claiml) before the word "tabs" insert the phrase --end panel locking--.

Signed and Sealed this

Twenty-fourth Day of August, 1993

*Attest:*

Bruce Lehman

BRUCE LEHMAN

*Attesting Officer*

*Commissioner of Patents and Trademarks*